US006829990B2

(12) United States Patent
Cochran et al.

(10) Patent No.: US 6,829,990 B2
(45) Date of Patent: Dec. 14, 2004

(54) STENCIL ASSEMBLY

(76) Inventors: Deborah Ann Cochran, 8294 Governors Walk, North Charleston, SC (US) 29418-2609; Geneva Cochran, 8294 Governors Walk, North Charleston, SC (US) 29418-2609; Melissa Renee Cochran, 5310 Alvie St., North Charleston, SC (US) 29418

( * ) Notice: Subject to any disclaimer, the term of this patent is extended or adjusted under 35 U.S.C. 154(b) by 0 days.

(21) Appl. No.: 10/434,652

(22) Filed: May 9, 2003

(65) Prior Publication Data

US 2004/0221754 A1 Nov. 11, 2004

(51) Int. Cl.[7] ..... B05C 17/06
(52) U.S. Cl. ..... 101/127.1; 33/565; 434/87
(58) Field of Search ..... 101/114, 127, 101/127.1, 128, 128.1, 128.4, 129; 33/562, 563, 564, 565; 434/87

(56) References Cited

U.S. PATENT DOCUMENTS

| | | | | | |
|---|---|---|---|---|---|
| 2,218,451 | A | * | 10/1940 | Heyne | 101/415.1 |
| 3,633,286 | A | * | 1/1972 | Maurer | 434/87 |
| 3,731,402 | A | * | 5/1973 | Paul | 434/164 |
| 3,894,487 | A | * | 7/1975 | Miller | 101/129 |
| 3,903,617 | A | * | 9/1975 | Evans | 434/171 |
| 4,563,948 | A | | 1/1986 | Cafferty | |
| 4,852,483 | A | * | 8/1989 | Bussard | 101/128 |
| 5,100,324 | A | * | 3/1992 | Slayton | 434/87 |
| 5,203,706 | A | | 4/1993 | Zamir | |
| 5,979,313 | A | | 11/1999 | Fromm | |
| 6,142,071 | A | | 11/2000 | Fexer | |
| 6,158,339 | A | | 12/2000 | Blazek et al. | |
| 6,220,155 | B1 | | 4/2001 | Kimura | |

* cited by examiner

*Primary Examiner*—Ren Yan
(74) *Attorney, Agent, or Firm*—Harleston Law Firm; Kathleen M. Harleston

(57) ABSTRACT

A stencil assembly for applying a stenciled design or message on a surface includes: (a) a reusable stencil base framing an elongated opening straddled by two opposite, spaced-apart interior long edges; the stencil base further including at least one exterior long edge parallel to the interior long edge, and a number of female stencil base cut-outs along the long edges; and (b) a number of stencil pieces of sufficient size for close insertion in the opening; the stencil pieces being formed of a common material and generally having a common length; the stencil pieces being interchangeably arrangeable in the opening between the interior long edges; a majority of the stencil pieces each including an individual character cut-out for receiving a stenciling material; the stencil pieces further including at least one male stencil piece projection on at least one of its sides, the male stencil piece projection being insertable in at least one of the female stencil base cut-outs. A stencil kit is also included herein.

30 Claims, 8 Drawing Sheets

STENCIL ASSEMBLY

BACKGROUND OF THE INVENTION

1. Technical Field

The present invention relates to a lightweight, reusable stencil assembly for use in stenciling characters, like letters or numbers, or a design on a surface, such as a wall, pillar, fence, post, pot, handbag, canister, street curb, furniture, or fabric.

2. Background Information

Stencils are known for use in applying decorative designs and messages on surfaces, such as walls, clothing, and street curbs. There is a need, though, for an easy to use, inexpensive stencil that will allow a lay person to precisely apply a custom design or message on a variety of surfaces, including curved surfaces such as pillars, posts, canisters, and pots. There is also a need for a stencil kit with several stencil bases that can easily be connected end to end or in parallel so that a longer or more complex message or design can be printed or marked on the desired surface. The stencil assembly and stencil kit of the present invention fill these needs.

BRIEF SUMMARY OF THE INVENTION

The present invention is a reusable, lightweight stencil assembly for use in stenciling on a variety of surfaces. The easy to use stencil assembly includes:

(a) a reusable stencil base framing an elongated opening; the opening being straddled by two opposite interior spaced apart long edges; the stencil base further comprising at least one exterior long edge, preferably parallel to the interior long edges, and a plurality of female stencil base cut-outs along at least one of the long edges; and (b) a plurality of stencil pieces of sufficient size for close insertion in the opening; the stencil pieces being formed of a common material and generally having a common length; the stencil pieces being interchangeably arrangeable in the opening between the interior long edges; a majority of the stencil pieces each comprising an individual character cut-out; the stencil piece character cut-outs being configured to receive a stenciling material; the stencil pieces further comprising at least one male stencil piece projection on at least one of its sides, the male stencil piece projection being insertable in at least one of the female stencil base cut-outs. A preferred, flexible flexible embodiment is conformable to a non-planar surface. A preferred rectangular-shaped embodiment includes a leg in each of its four corners. A stencil kit is also included herein.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1:
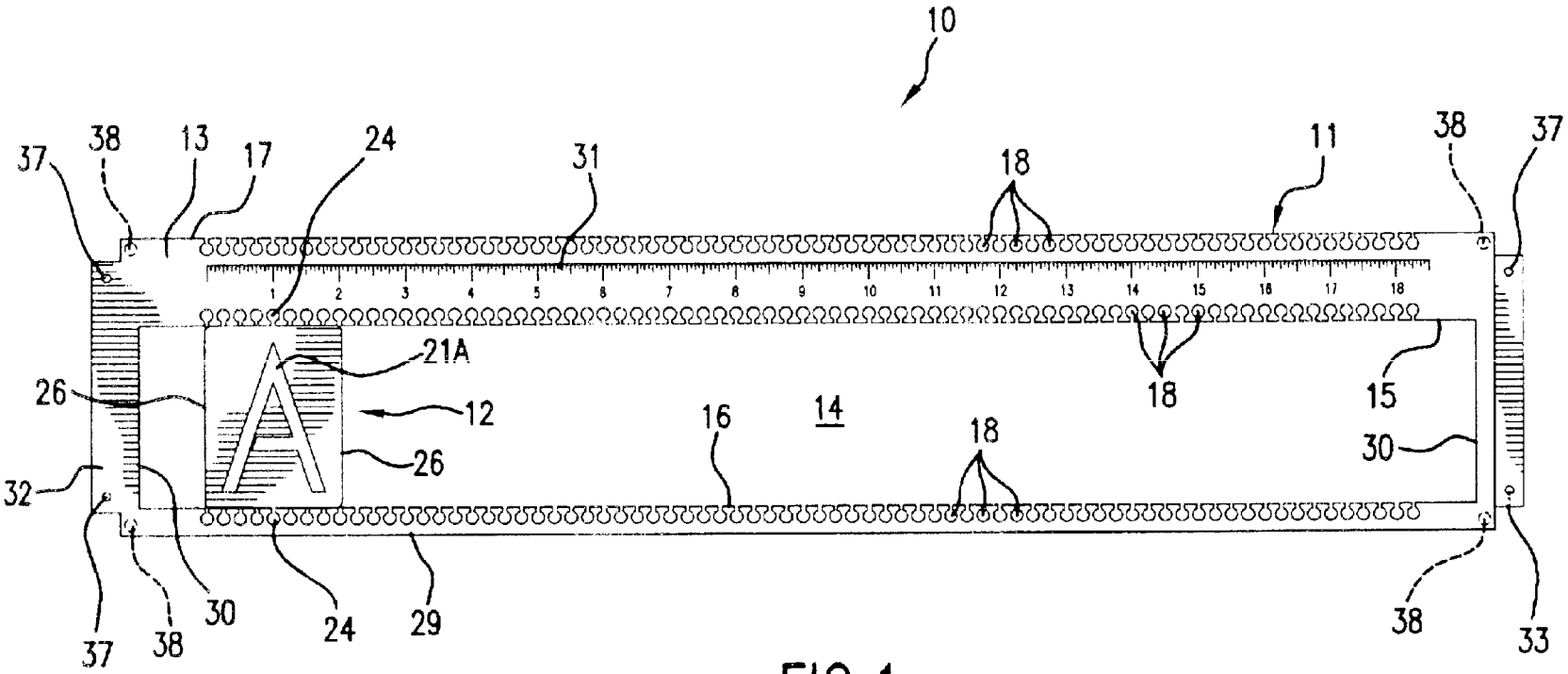
FIG. 1 is a front elevational view of a stencil assembly according to the present invention, shown with a stencil piece having a capital letter "A" cut-out.

In the following description, like reference characters designate like or corresponding parts throughout the several views. Also, in the following description, it is to be understood that such terms as "front," "back," "within," and the like are words of convenience and are not to be construed as limiting terms. Referring in more detail to the drawings, the invention will now be described.

Turning first to FIG. 1, a lightweight, reusable stencil assembly 10 according to the present invention includes a stencil base 11 and at least one removable stencil piece 12. To use the stencil assembly 10, a user selects stencil pieces 12 and inserts them in the stencil base 11 to form custom designs, numbers, words, etc. The user then places the completed stencil assembly 10 on a surface, such as a wall, fence, post, pillar, pot, handbag, canister, street curb, block of wood, metal item, cardboard, canvas, item of furniture, or clothing item, and applies paint, dye, or another colorant material to the message or design in the stencil assembly. The user then removes the stencil assembly, and allows the painted or sprayed on message or design on the surface to dry. The stencil assembly 10 is usable, for example, for stenciling letters, words, poems, designs, etc. on an interior bedroom or bathroom wall or any other suitable surface as a decoration or message. For example, a strand of ivy can be painted around the top of a column, or titles of ingredients can be marked on a set of kitchen canisters. The stencil assembly herein is also useful for use in wood etching projects, for example.

The stencil base 11 shown in FIG. 1 has a generally rectangular-shaped, relatively planar frame 13 outlining an elongated, preferably generally rectangular-shaped, opening 14 formed in the stencil base. Two opposite interior long edges, 15, 16, which are in parallel spaced relationship, straddle the opening 14. Corresponding ends of the two interior long edges are connected to one another by interior short edges 30, which are also in parallel spaced relationship and border the opening. The stencil base 11 also includes at least one exterior long edge 17, and preferably two opposite exterior long edges above and below the opening 14, respectively. A series of spaced apart, side by side cut-outs, preferably same-sized, generally keyhole-shaped cut-outs 18, are formed along the interior upper and lower long edges 15, 16 and the upper exterior long edge 17 of the stencil base.

Figure 2:
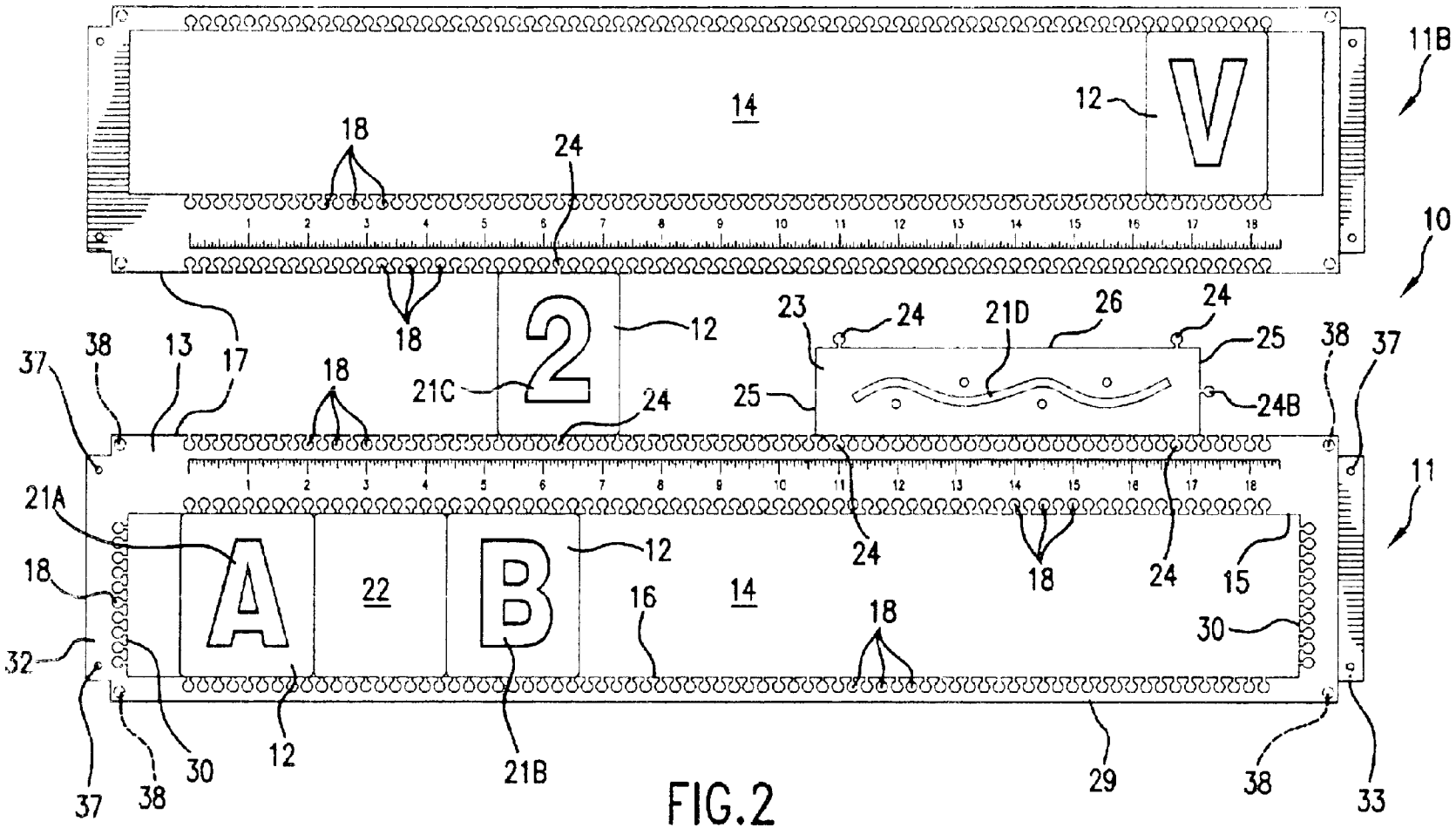
FIG. 2 is a front elevational view of a stencil assembly according to the present invention, shown with five different stencil pieces.

As shown in FIGS. 1 and 2, the stencil assembly 10 includes a number of stencil pieces 12, each of a sufficient size for close insertion and alignment within the base opening 13. A majority of the stencil pieces in a set have an individual letter, number, or design cut-out 21 in the piece. The stencil piece cut-out 21 is configured to receive a colorant or other stenciling material. The colorant material may be applied, for example, by spraying or brushing the colorant material over the stencil pieces. Alternatively, the cut-out characters may be outlined with the colorant material and optionally filled in with colorant material at a later time. By "colorant material" is meant liquid or spray-on paint, marker, etc. of any color or texture. The character cut-out 21 on the stencil piece 12 is preferably a number between 1 and 9, a capital or lower case alphabet letter between A and Z, or a design. Designs suitable for inclusion on the stencil pieces include outlines or symbols, such as "", "*", "%", "&", or "©". The stencil pieces 12 are preferably formed of a common material and generally have a common length, and most preferably a common width and thickness. Not all of the stencil pieces 12 have a cut-out 21; some are solid barrier spacer pieces 22 for preventing paint from marking spaces between words, numbers or designs, as shown in FIG. 2.

FIG. 1 shows a removable stencil piece 12 with a capital letter "A" cut-out 21 in a stencil base 11. FIG. 2 shows a variety of stencil pieces 12, including two stencil pieces with capital letter "A" and "B" cut-outs 21A, 21B, respectively, with a spacer piece 22 between the two; a stencil piece with a number "2" cut-out 21C; and a design stencil piece 23 showing an undulating line segment cut-out 21D. FIG. 2 also shows a second stencil base 11B in an upside down position. A stencil piece 12 having a capital letter "V" cut-out 21D has been inserted in the second stencil base 11B. All of the stencil pieces 12, 22, 23 have knob projections 24, which have been inserted in corresponding generally keyhole-shaped cut-outs 18 along an interior or exterior long edge. A knob projection 24 at the top short side of stencil piece 12 with the number "2" cut-out 21C has been inserted in a corresponding generally keyhole-shaped cut-out 18 in the upper exterior edge 17 of the second stencil base 11B. The first and second stencil bases 11, 11B are thus interconnected, which is useful for writing a more complex message or design for application on the selected surface.

A string of letters (e.g., ABCs, a person's name, words, a haiku), numbers (e.g., a telephone number or address), or designs (e.g., a line of fish, teddy bears, or other animal outlines) can be created by inserting the appropriate stencil pieces 12 side by side into the opening in the stencil base 11. The stencil pieces 12 are constructed so that they closely abut one another, without leaving cracks between stencil pieces for the paint or other stenciling material to leak through and ruin the design or message being applied to the selected surface. The stencil pieces are readily interchangeable.

The stencil pieces 12 further include at least one male stencil piece projection on at least one of its sides. The male stencil piece projection interlocks with at least one of the female stencil base cut-outs. In the preferred embodiment shown in FIGS. 3 through 5, each substantially rigid stencil piece 12 has at least one generally keyhole-shaped knob projection 24 on each opposite short side 25 of the generally rectangular-shaped stencil piece 12. As shown in FIGS. 1 and 2, the generally keyhole-shaped cut-outs 18 on the long interior and exterior sides 15, 16, 17 of the stencil base 11 are adapted for closely receiving the similarly shaped knob projections 24 on the opposite short sides of the stencil pieces 12.

Figure 4:
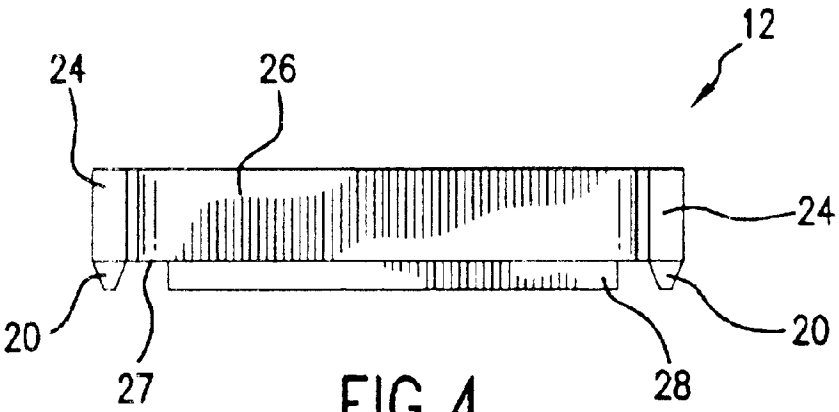
FIG. 4 is a side elevational view of the stencil piece of FIG. 3.
Figure 5:
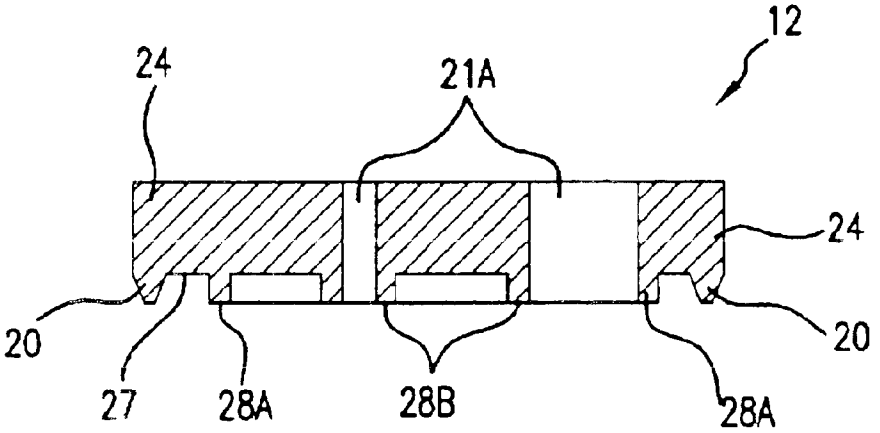
FIG. 5 is a cross-sectional view of the stencil piece of FIG. 3, taken along line 5—5.
Figure 3:
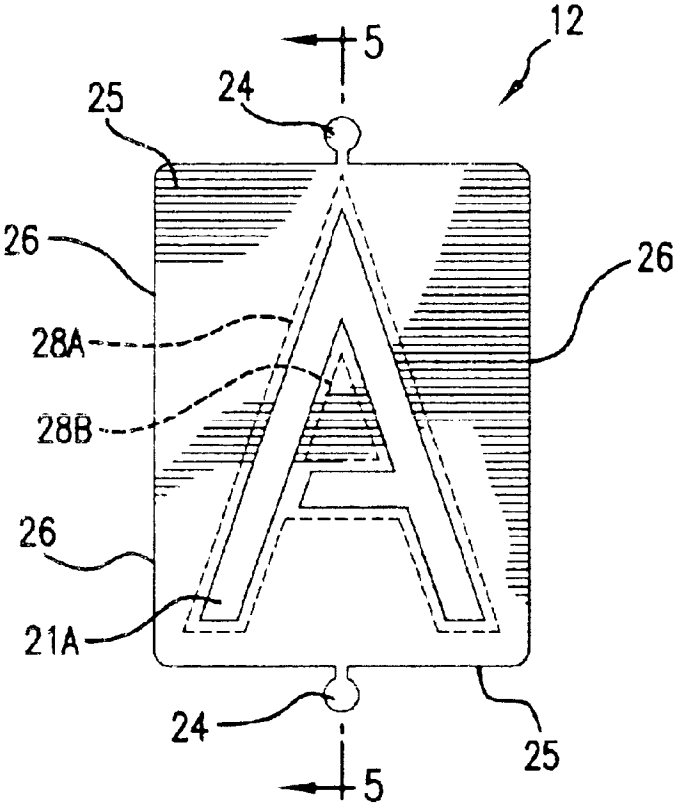
FIG. 3 is a front elevational view of a stencil piece according to the present invention, showing a capital letter "A" cut-out.

The stencil piece 12 shown in FIGS. 3 through 5 includes a capital letter "A" cut-out 21A, which extends through the thickness of the stencil piece. FIG. 4 shows a long side 26 of the generally rectangular-shaped stencil piece 12, with the knob projections 24 visible on its opposite ends. The stencil piece 12 is preferably made with a rigid skirt 28, or wall, extending around the outside 28A, and inside 28B, if there is one, of the character cut-out 21, as shown in hidden line in FIG. 3. The skirt 28 extends down a short distance from the bottom face 27 of the stencil piece 26, as shown in FIG. 4. Importantly, this thin-walled skirt 28 prevents wet colorant material from bleeding or otherwise leaking outside the cut-out area during application, which could ruin the design or message being printed on the selected surface. The edges of the message or design are instead crisp and well-defined.

FIG. 5 shows a cross-section through the longitudinal centerline of the stencil piece 12, with the knob projections 24 shown on its opposite ends, and the skirt 28 extending down around the perimeter of the character cut-out 21A. The bottom ends 20 of the knob projections 24 are rounded as shown in FIGS. 4 and 5. Without meaning to be bound by theory, this is thought to hold down any rocking of the stencil pieces within the stencil base. It is also believed that the round knob projections in their corresponding rounded cut-outs keep the stencil assembly level on the selected surface. If the stencil pieces in the stencil base were not at different levels, the colorant material would be more likely to be applied unevenly. Also, the stencil assembly herein may include a level for leveling the stencil on the surface.

A stencil piece 12 may include two or more knob projections 24 on each long side 26 for added stability, as shown on the design stencil piece 23 on the upper exterior long edge 17 in FIG. 2. The design stencil piece 23 shown in FIG. 2 is longer and narrower than the other stencil pieces shown. This is to illustrate that the stencil pieces 12, 22, 23 in a set can come in a variety of different sizes, which may be employed in or on a single stencil base 11, or several stencil bases. The stencil piece 23 can be used right side up as shown, sideways, or upside down, as desired. One or more stencil pieces may include knob projections 24B along one or two sides 25, as shown in FIG. 2 on the design stencil piece 23, so that the stencil piece can be hung in one of the generally keyhole-shaped cut-outs 18 along one or both interior end edges 30 on either end of the base opening 14, in addition to or instead of using the knob projections 24 along the long sides 26 of the stencil piece.

To use the stencil assembly 10, the user lines the knobs 24 up with corresponding generally keyhole-shaped base cut-outs 18 on opposite interior long sides 15, 16 of the stencil base 11 and allows the stencil piece 12 to drop into the base opening 14. The series of same-sized, generally keyhole-shaped base cut-outs 18 along several different sides of the stencil base affords a variety of options for placing the stencil pieces within the base opening 14. The ruler marking 31 printed on the frame 13 is for the user's markings 31 can be used to measure distances between the letters, etc. on stencil pieces. The ruler markings may be color coded.

In embodiments that include the generally keyhole-shaped cut-outs 18 along an exterior long side 17 of the stencil base 11, as shown in FIG. 2, the stencil pieces 12 can also be used on the upper exterior long edge 17 (and/or the lower exterior long edge 29) of the stencil base 11. Thus, several horizontal lines of text or designs can be applied to the surface at the same time (e.g., a short poem). Even though only the knob or knobs 24 along one side of the stencil piece 12, 23 are employed in this case, the squared off edges of the stencil piece and its rigid construction prevent the stencil piece from wobbling in the generally keyhole-shaped cut-out 18.

The stencil base 11 and stencil pieces 12, including the knob projections 24 and skirts 28, are preferably made of a plastic-type material or a wood or wood substitute material so that it is durable, reusable, and somewhat rigid. It can also be made of foam, rubber, vinyl, metal, paper laminate, plastic coated paper, or any other suitable material. The stencil bases 11 and stencil pieces 12 may be made by any suitable method of manufacture, such as molding, cutting, stamping, casting, etc.

The fit between the male stencil piece projections 24 and the female base cut-outs 18 enables the stencil pieces 12 to remain in the base opening 14, even where the stencil base 11 is on a vertical or curved surface. The stencil base preferably does not include tracks for holding in the stencil pieces. No clips, strips, or overlay is required to hold the stencil pieces in the stencil base.

The stencil base 11 should be of a length and width that is easy to hold or tack on a surface while applying the colorant material. The stencil base should not be so long that it is unwieldy during use.

Figure 6:
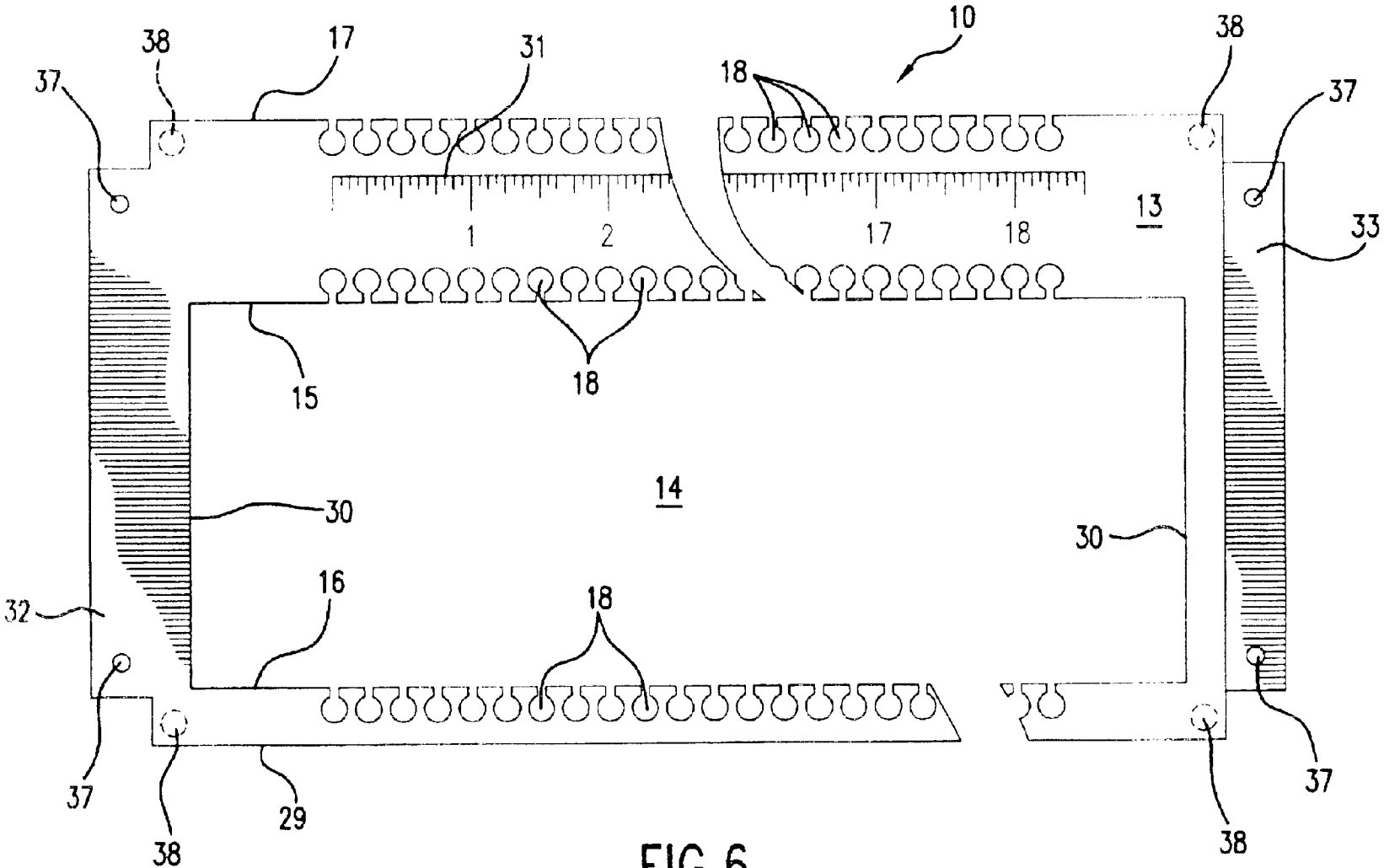
FIG. 6 is an enlarged front elevational view of the stencil base according to FIG. 1, showing opposite ends of the stencil base.
Figure 7:
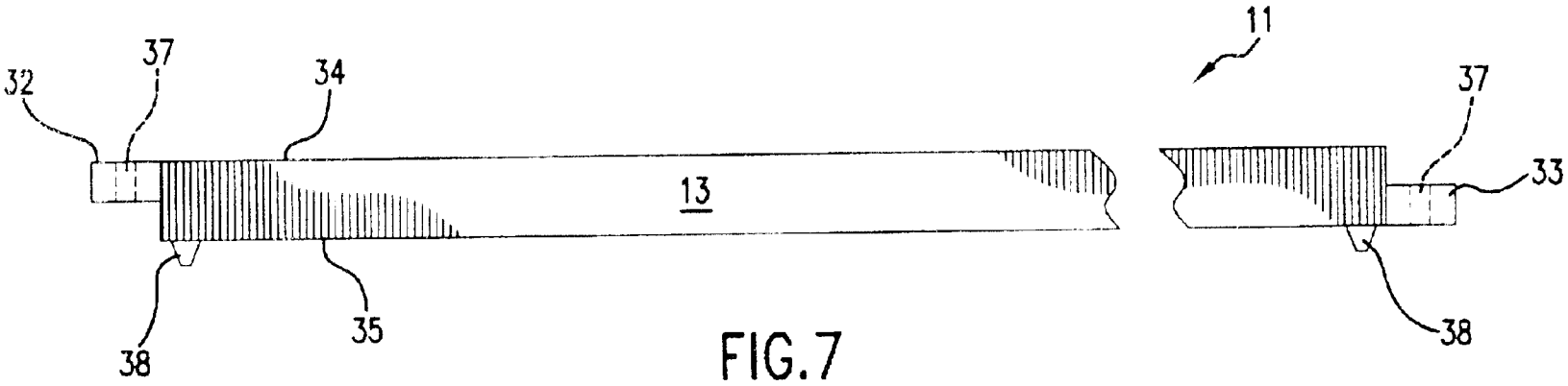
FIG. 7 is a top plan view of the stencil assembly of FIG. 1, showing opposite ends of the stencil base.

Turning to FIGS. 6 and 7, the end portions of the stencil base 11 include upper and lower end tabs 32, 33 extending in a horizontal direction on the same plane as the base frame 13. The upper end tab 32 extends out from the top face 34 of the stencil base 11, and the lower end tab 33 extends from the bottom face 35 of the stencil base 11, as depicted in FIG. 7. As seen in FIGS. 6 and 7 (in hidden line), each end tab 32, 33 has two holes 37 in its opposite ends. This embodiment of the stencil base 11 also includes a leg 38 on the bottom face 35 of the stencil base at each of its four corners. The legs suspend the stencil base slightly above the surface to be painted/marked. The stencil pieces 12 are preferably substantially the same thickness as the thickness of the stencil base 11, with the width of the skirt 28 substantially equaling the height of the legs 38. The skirt 28 preferably extends down so that its lower edge touches the surface to be decorated/marked.

Figure 8:
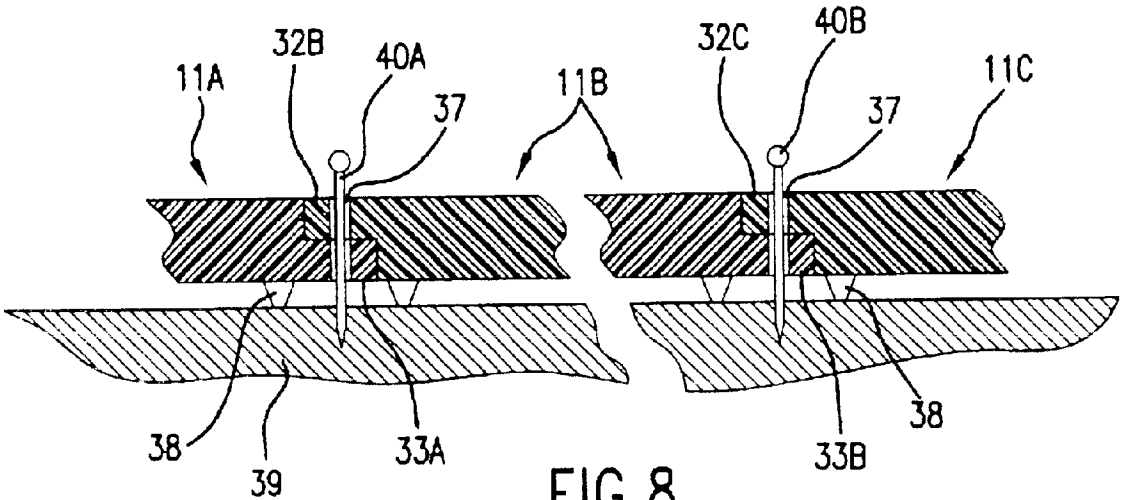
FIG. 8 is an illustrative cross-sectional view of portions of three connected stencil bases according to the present invention, shown in use on a wall.

Referring to FIG. 8, each of the tab holes 37 accommodates a pin or tack 40 for removably attaching the stencil assembly to the surface 39 to be decorated/marked. A conventional straight pin or thumb tack is satisfactory. The upper end tab 32B of a first stencil base 11B fits closely over the lower end tab 33A of a second stencil base 11A. A first pin 40A extends through the holes 37 in the end tabs 32B, 33A of the first and second stencil bases 11A, 11B into the surface 39. Likewise, the lower end tab 33B of the first stencil base 11B fits closely over an upper end tab 32C of a third stencil base 11C. A second pin 40B fits closely through the holes 37 in the end tabs 32C, 33B into the surface 39. Thus, the pins 40A, 40B hold connected stencil assemblies 10 on the surface 39 so the user can have both hands free to paint, etc. When the task is complete, the stencil assemblies are easily removed from the surface 39, leaving only barely visible pin holes in the surface of the wall, fabric, etc. The stencil bases 11A, 11B can then be reused. This is particularly well-suited for stenciling borders on the difficult to reach tops of interior walls.

Included herein are stencil kits comprising connectable, reusable stencil bases and various sets of stencil pieces as described herein. A preferred stencil kit of the present invention includes several connectable stencil bases, and several sets of stencil pieces. A majority of the stencil pieces have cut-outs, such as alphabet stencil pieces with several different sizes (e.g., capitals and lower case letters) and various fonts, and some are blank spacer pieces. The stencil pieces with cut-outs depict, for example, flora (e.g., a set with a variety of flowers, individual leaves) and fauna (e.g., pieces showing amphibians and reptiles, mammal babies, sea creatures, dinosaurs), vehicles (e.g., pieces picturing fire truck, racer, dump truck), ballet-related designs (e.g., pieces showing ballet shoes, ribbon bows), and tools (e.g., hammer, screw driver, pliers).

The stencil pieces 12 may include corresponding side joints, such as tongue and groove joints (not shown), on the sides of the stencil pieces to further help align the stencil pieces in a side by side configuration with no space between the stencil pieces for leaks. Other shapes for the stencil pieces are included herein. A negative design may be imparted by spraying paint over a opening holding blank spacer pieces of a desired shape. For example, pink paint can be sprayed in a rectangular base opening holding side by side flower-shaped spacer pieces, leaving the impression of a rectangular pink background with linked, circular flower heads once the stencil assembly is removed.

The stencil bases may be detachably interconnected in spaced parallel relationship as shown in FIG. 2. Additional stencil bases can be detachably attached to the end tabs 32, 33 on either or both of the stencil bases 11, 11B, forming an end to end detachable interconnection.

The stencil piece cut-outs need not be clean cuts as shown in FIGS. 1 and 2. The cut-outs may be stippled, striped, or polka dotted, for example. This can be used to achieve, for example, tiger striped letters or polka dot designs.

If desired, a user may apply adhesive tape over a portion of the stencil piece cutout(s) to block the particular colorant material being applied. A user may, for example, apply adhesive tape over X area, spray a first color onto the remaining Y area, remove that tape, apply new adhesive tape over the sprayed-over Y area, spray a second color over X area, and remove the stencil assembly, leaving the two tone message, number, or design.

Figure 9:
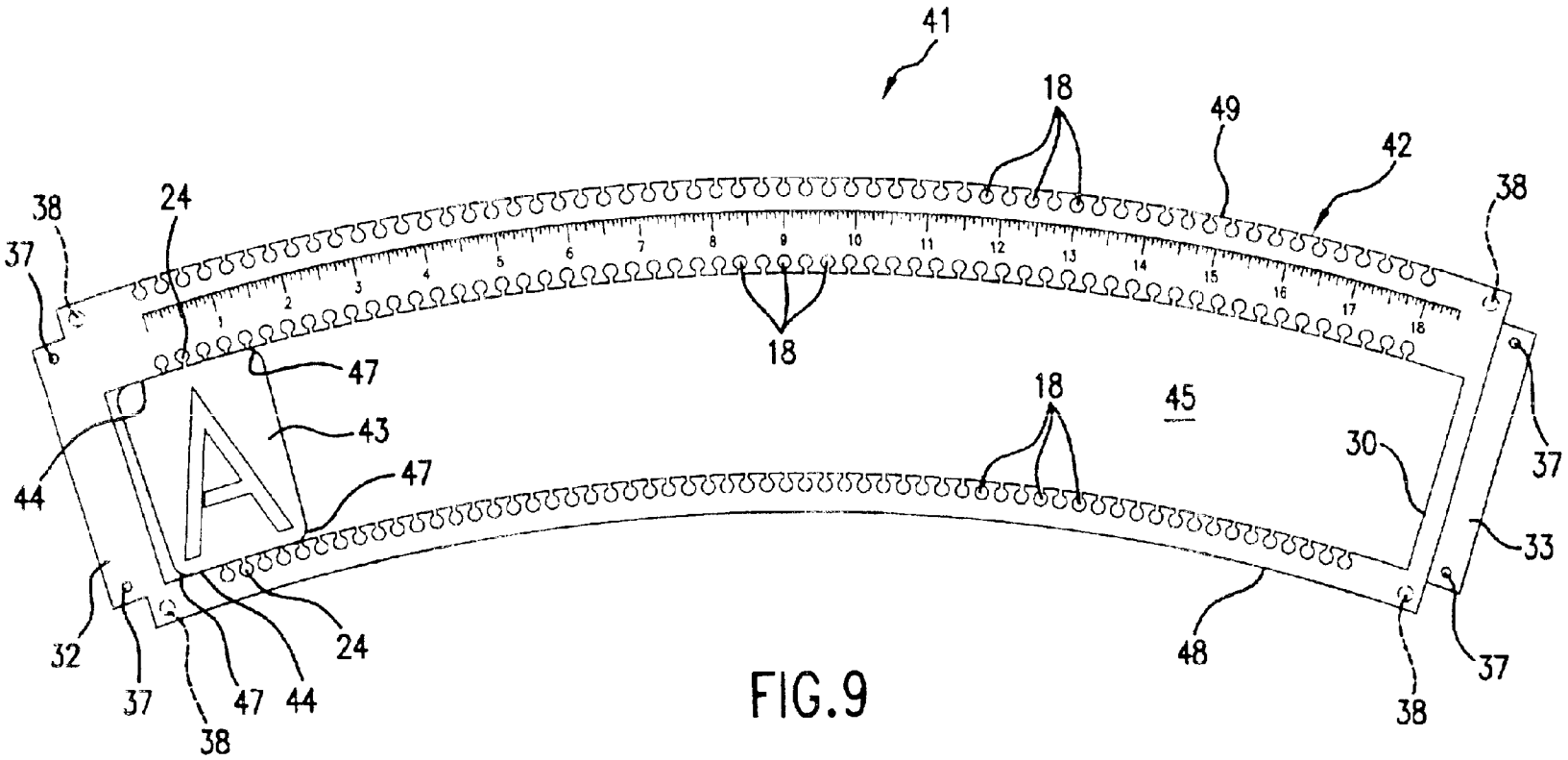
FIG. 9 is a front elevational view of an alternate embodiment of a stencil assembly according to the present invention, shown with a stencil piece in place.

Turning now to FIG. 9, an alternate embodiment 41 of the stencil assembly includes an arc-shaped stencil base 42, with a curved lower exterior long edge 48 beneath a longer curved upper exterior long edge 49. This curved embodiment 41 is particularly well-suited for applying designs and words to the fronts of T-shirts and caps. The stencil base may be curved more or less; various degrees of curvature are intended to be included herein. The short sides 44 of the stencil pieces 43 are also curved so that they fit into the arc-shaped opening 45 of the curved stencil base 42, and the corners 47 of the stencil pieces 43 are rounded, rather than sharp as in the stencil piece 12 shown in FIG. 1.

Figure 10:
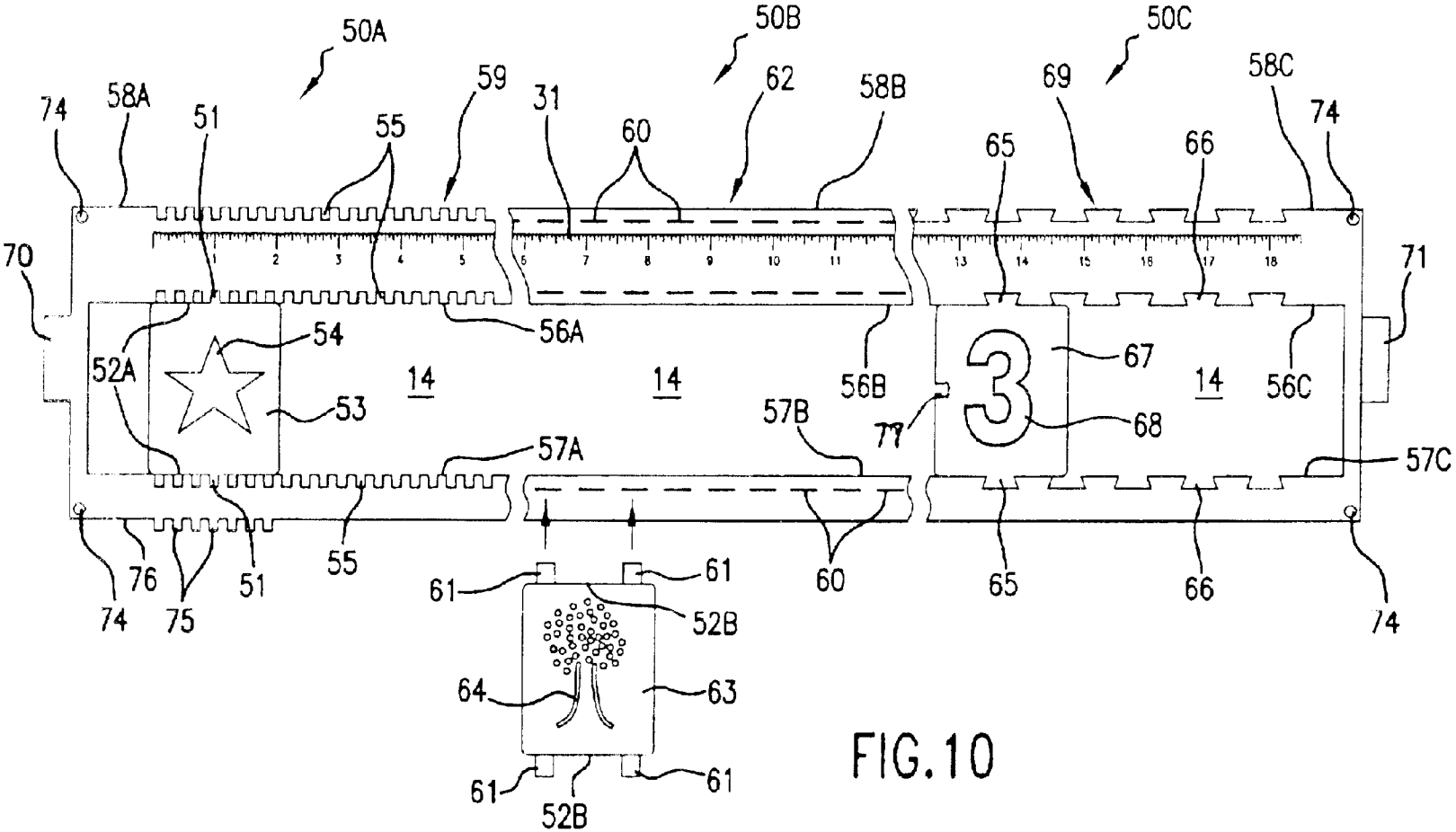
FIG. 10 is a front elevational view of an alternate embodiment of a stencil assembly according to the present invention, shown with a stencil piece in place.

Turning to FIG. 10, alternate, related embodiments 50A, 50B, 50C of a stencil assembly according to the present invention include various shaped projections on stencil pieces that correspond to similarly shaped cut-outs along the long edges of the stencil base. In the first embodiment 50A of FIG. 10, the stencil piece 53 has a star-shaped stencil piece cut-out 54. Squared-off, three-sided projections 51 on opposite short sides 52A of the stencil piece 53 correspond to a series of same-sized, side by side, squared-off base cut-outs 55 along the stencil base's interior long edges 56, 57, and along the upper exterior long edge 58 of the stencil base 59. The interior long edges 56, 57 border the rectangular-shaped, thin, relatively planar stencil base opening 14.

In use, stencil pieces 53 are selected to fit closely side by side into the stencil base opening 14, or along the upper exterior long edge 58. The squared off projections 51 on each stencil piece 53 fit into the corresponding squared-off base cut-outs 55, which resemble dental molding. Each stencil piece 53 is pressed into the base opening 14. Alternatively, the squared-off projection 51 along a lower short side 52A of a stencil piece 53 is pressed into a corresponding squared-off base cut-out 55 along the upper exterior long edge 58A of the stencil base 59.

Second, slits 60 in stencil assembly embodiment 50B in FIG. 10 receive generally rectangular-shaped, three-sided projections 61. Here, the stencil base 62, and preferably the stencil pieces, are made of a thin, flexible, lightweight material, such as a plastic. This flexible embodiment is particularly well-suited for use around a pillar, post, canister, flower pot, couch arm, bean bag chair, or other curved or circular surface. This embodiment SOB may also be used in its flat position, as shown. While stencil assembly embodiment 50A shows a single squared-off projection 51 on each short side 52A of the stencil piece 53, embodiment 50B shows two matching, flexible, longer, generally rectangular-shaped projections 61 on each short side 52B of the second stencil piece 63. These bendable, generally rectangular-shaped projections 61 are slidable into corresponding slits 60 proximate to the interior long edges 56B, 57B, or an exterior long edge 58B, of the flexible stencil base 62, as indicated in FIG. 10. Although any number, letter, or shape may be employed, the second stencil piece 63 of embodiment 50B in FIG. 10 is shown with a tree-shaped cut-out 64. A series of short, same-sized slits 60 is provided. Each slit 60 is approximately the width of a rectangular-shaped projection 61. The horizontally oriented slits are substantially parallel to the horizontally oriented long edges of the stencil base. Of course, the stencil base can also be used vertically, where the designs on the stencil pieces allow for vertical usage.

Third, the stencil embodiment 50C of FIG. 10 includes a third stencil piece 67 having dovetail projections 65. The male dovetail projections 65 fit into corresponding female base dovetail cut-outs 66 on the stencil base. The dovetail shape of the projections and cut-outs allows for a stable stencil piece that does not rock back and forth, is more likely to remain in place side by side with other stencil pieces, and is less likely to fall out of the stencil assembly when it is in a vertical position (e.g., on a wall). The male dovetail projections 65 correspond to the female dovetail cut-outs 66 along the interior long edges 56C, 57C, or the upper exterior long edge 58C, of the stencil base 69. Although any number, letter, or shape may be employed, the third stencil piece 67 of embodiment 50C in FIG. 10 is shown with a number "3" cut-out 68.

Along with the ruler 31 on the stencil bases 59, 62, 69, FIG. 10 shows end tabs 70, 71. As seen from the top of the stencil base in FIG. 11, an upper end tab 70 extends out in a generally horizontal direction from the top face 34 of the stencil base 59, 62, or 69, and a lower end tab 71 extends out in a generally horizontal direction from the bottom face 35 of the stencil base. The upper end tab 70 has a nub, or male snap member 72 on its lower surface that corresponds to a small projection, or female snap member 73 on the top surface of the lower end tab 73. When two stencil bases are placed end to end, the male snap member 72 of a first stencil base snaps into the female snap member 73 of the adjacent, second stencil base. This is particularly well-suited for the flexible plastic stencil assembly embodiment 50B.

In use, stencil pieces are selected to fit closely side by side into the stencil base opening 14, or along the exterior long edge 58. The first stencil assembly is placed on the curved surface, such as a pillar, and the end tabs 70, 71 of a second stencil assembly are snapped onto the corresponding end tabs of the first stencil assembly. Depending on the circumference of the pillar, three or four stencil assemblies can be snapped end to end around the pillar. Once the paint is applied over the attached stencil assemblies, the stencil assemblies can be unsnapped, dismantled, cleaned, and later reused.

Along with connecting the stencil assemblies end to end, they can also be connected in parallel, including side by side connection. To connect them in parallel, the user would insert one or more stencil pieces 12 (or 53, 63, 67 in alternate embodiments), optionally with spacer pieces 22, in base cut-outs 18 (or 24, 55, 66 or slits 60 in alternate embodiments) along the upper exterior long edge 17 (or 58) of the first stencil base 11 (see FIGS. 2, 9 and 10). As depicted in FIG. 2, the user then connects a second stencil base 11B or assembly to the upper projection 24 (or 51, 61, 65, in alternate embodiments) or projections of these stencil piece(s) 12 by placing the upper projection 24 into a matching base cut-out 18 on an exterior lower or exterior upper, if the second stencil base is upside down as in FIG. 2, long edge 17, 29 (or 58) of the second stencil base. Three lines of text and/or designs are thus provided. For example, the word "Twinkle" can be painted above the words "Lil' Star", with several stars in between the two lines. Different colors of paint can be used on the different lines, if desired. A third, fourth, etc. stencil assembly can be connected above and/or below these two stencil assemblies to obtain the desired number of lines.

Stencil bases/assemblies can alternatively be connected side by side via base projection(s) 75 extending beyond the lower exterior long edge 76 (or an upper exterior long edge 17 or 58) of a first stencil assembly 50, as shown in FIG. 10. Dovetail projections/cut-outs are preferred for this purpose, since they are less likely to detach. The stencil base projections 75 fit into corresponding stencil base cut-outs 55 (or slits 60 in an alternate embodiment) on an upper exterior long edge 58 of a similar second stencil base/assembly (see FIG. 10). Continuing with FIG. 10, some stencil pieces 67 include a cut-out 77 along one side (or two sides), which corresponds to a similarly shaped projection 51, 75 on a corresponding stencil piece 53 or on the stencil base 59. This enables stencil pieces to be detachably interlocked with one another, in addition to allowing the stencil pieces to be detachably interlocked with the stencil base in various positions. This feature is particularly useful for adding physical stability where the stencil pieces are inserted above or below the stencil base along an exterior long edge (since no frame is provided in that case). It also allows a stencil piece with a design cut-out, for example, to be used right side up, upside down, or sideways, depending on how the stencil piece is inserted on the stencil base.

The projections on the stencil pieces and the corresponding cut-outs on the stencil bases herein may be mixed and matched. For example, one stencil base may have rectangular-shaped, possibly squared-off ("dental"), projections, and/or dovetail projections, and corresponding base cut-outs, possibly slits, adjacent to one another, or with one type of cut-out on one interior long edge, for example, and another type of cut-out on the other interior long edge, or on an exterior long edge. This can be used as a means of controlling placement of the stencil pieces with their corresponding projections and would be useful for preventing an inept user, for example, from making mistakes. Likewise, the projections on the first exterior long edge of the first stencil base, and the corresponding cut-outs on the other exterior long edge of the second stencil base, may be mixed and matched.

Stencil assemblies can be connected in various patterns, depending on the desired end result. For example, first and second stencil assemblies can be connected end to end, with third and fourth stencil assemblies connected in parallel with the first and second, respectively, above or below the first and second stencil assemblies. Alternatively, the third stencil assembly can be connected to adjacent end portions of both the first and second stencil assemblies.

Other detachable coupling mechanisms may be employed on the stencil bases in place of snaps, such as lock and loop strips or two-sided tape on the end tabs, hinged end tabs, or a bracket (not shown) that clips over both end tabs once they are together. Alternatively, a first end tab of a first stencil base comprises a male projection, preferably a dovetail projection, which is less likely to detach, and a corresponding second end tab of a second stencil base comprises a corresponding female cut-out, as described herein. The first end tab is insertable in the second end tab, allowing temporary end to end linkage of the first and second stencil bases.

Figure 11:
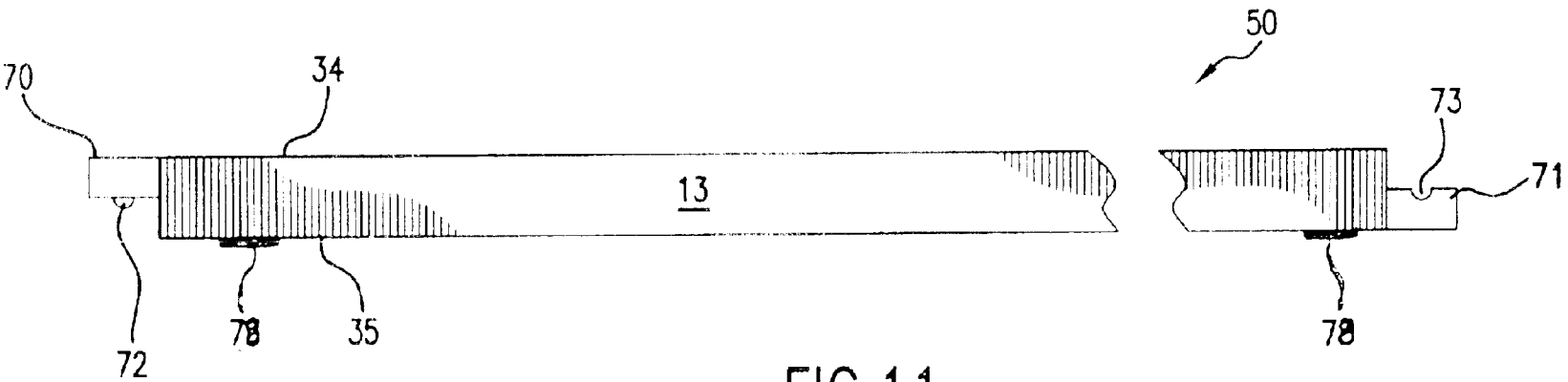
FIG. 11 is a top plan view of the stencil assembly according to FIG. 10, showing opposite ends of the stencil base.

Although the stencil embodiment shown in FIGS. 10 and 11 does not include legs, it does include small holes 74 in its four corners for receiving push pins, if desired, for holding the stencil base in place on a wall or other vertical surface (see FIG. 11). The bottom face 35 of the stencil base (see FIG. 11) may have pieces 78 of a tacky or sticky material or padding for preventing the stencil base from sliding on a slick surface, or for temporarily retaining the stencil base on the surface, such as lock and loop strips, adhesive material, or a felt material.

From the foregoing it can be realized that the described device of the present invention may be easily and conveniently utilized as a stencil. It is to be understood that any dimensions given herein are illustrative, and are not meant to be limiting.

While preferred embodiments of the invention have been described using specific terms, this description is for illustrative purposes only. It will be apparent to those of ordinary skill in the art that various modifications, substitutions, omissions, and changes may be made without departing from the spirit or scope of the invention, and that such are intended to be within the scope of the present invention as defined by the following claims. It is intended that the doctrine of equivalents be relied upon to determine the fair scope of these claims in connection with any other person's product which fall outside the literal wording of these claims, but which in reality do not materially depart from this invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

BRIEF LIST OF REFERENCE NUMBERS Used in the drawings

10 stencil assembly
11 stencil base
12 stencil pieces
13 base frame
14 base opening
15 upper interior long edge
16 lower interior long edge
17 upper exterior long edge
18 keyhole-shaped cut-outs
21 stencil piece cut-out
22 spacer piece
23 design stencil piece
24 knob projections
25 short side of stencil piece
26 long side of stencil piece
27 bottom face of stencil piece
28 skirt on stencil piece
29 lower exterior long edge
30 interior end edge
31 ruler markings
32 upper end tab
33 lower end tab
34 top face of stencil base
35 bottom face of stencil base
37 end tab holes
38 leg of stencil base
39 surface
40 tack/pin
41 curved stencil assembly
42 curved stencil base
43 stencil piece
44 short sides of stencil piece
45 arc-shaped opening
47 corners of stencil pieces
48 curved lower exterior long edge
49 curved upper exterior long edge
50A–C alternate embodiments of stencil assembly
51 squared-off projection of 50A
52A,B short sides of stencil pieces
53 stencil piece with star-shaped cut-out
54 star-shaped stencil piece cut-out
55 squared-off base cut-outs
56A–C interior upper long edge
57A–C interior lower long edge
58A–C upper exterior long edge
59 stencil base of 50A
60 slits in 50B
61 rectangular-shaped projections in 50B
62 stencil base in 50B
63 second stencil piece in 50B
64 tree-shaped cut-out in 50B
65 dovetail projections in 50B
66 dovetail base cut-outs in 50C
67 third stencil piece in 50C
68 numerical stencil piece cut-out in 50C
69 stencil base of 50C
70 upper end tab
71 lower end tab
72 male snap member
73 female snap member
74 corner holes
75 base projection
76 exterior lower long edge
77 projection cut-out on stencil piece
78 material pieces

What is claimed is:

1. A lightweight, reusable stencil assembly for applying a design or message on a surface, the assembly comprising:

(a) a reusable stencil base framing an elongated opening; the opening being straddled by two opposite interior, spaced apart long edges;

the stencil base further comprising at least one exterior long edge, and a plurality of female stencil base cut-outs along at least one of the long edges; the stencil base being flexible and conformable to a non-planar surface; and (b) a plurality of stencil pieces of sufficient size for close insertion in the opening; the stencil pieces being formed of a common material and generally having a common length; the stencil pieces being interchangeably arrangeable in the opening between the interior long edges; a majority of the stencil pieces each comprising an individual character cut-out; the stencil piece character cut-outs being configured to receive a stenciling material; the stencil pieces further comprising at least one male stencil piece projection on at least one of its sides, the male stencil piece projection being insertable in at least one of the female stencil base cut-outs.

2. A stencil assembly according to claim 1, wherein each of the male stencil piece projections has a shape closely corresponding to the shape of at least one of the female stencil base cut-outs.

3. A stencil assembly according to claim 1, wherein the stencil base is generally rectangular in shape, with the two opposite interior long edges in parallel spaced relationship straddling the opening, and two of the at least one opposite exterior long edges in parallel spaced relationship above and below the interior long edges, respectively.

4. A stencil assembly according to claim 3, wherein the stencil base does not comprise tracks.

5. A stencil assembly according to claim 4, wherein corresponding ends of the two interior long edges are connected to one another by interior short edges, which are in parallel spaced relationship and border the opening.

6. A stencil assembly according to claim 5, wherein at least two interior or exterior long or short edge of the stencil base comprise a series of same-sized, generally keyhole-shaped cut-outs.

7. A stencil assembly according to claim 6, wherein the stencil pieces are generally rectangular in shape, and have a common thickness substantially equal to the thickness of the opening.

8. A stencil assembly according to claim 7, wherein the stencil pieces generally have a common width and thickness.

9. A stencil assembly according to claim 7, wherein each of the stencil piece projections and each of the stencil base cut-outs is generally rectangular in shape.

10. A stencil assembly according to claim 7, wherein the character cut-out has the shape of a letter, number, or design.

11. A stencil assembly according to claim 10, wherein an end tab extends outwardly from each of the opposite ends of the stencil base, an upper one of the end tabs extending from a top face of the stencil base, a lower one of the end tabs extending from a bottom face of the stencil base.

12. A stencil assembly according to claim 11, wherein each of the end tabs is generally horizontally oriented and comprises a generally vertically oriented hole for receiving a pin.

13. A stencil assembly according to claim 10, wherein the stenciling material is a colorant material.

14. A stencil assembly according to claim 1, wherein the opening and the stencil base are arc-shaped.

15. A stencil assembly according to claim 1, wherein at least one of the stencil pieces further comprises at least one female cut-out on a second one of its sides, the female cut-out being interlockable with a corresponding male projection of a second stencil piece or the stencil base.

16. A stencil assembly according to claim 1, wherein the stencil base is made of a flexible, plastic-type material and the surface is curved.

17. A stencil assembly according to claim 16, wherein each of the stencil piece projections is generally square-shaped and bendable, and the stencil base cut-outs are generally horizontally oriented slits, each of the slits having substantially the same length as each of the projections.

18. A lightweight, reusable stencil assembly for applying a design or message on a surface, the assembly comprising:

(a) a reusable stencil base framing an elongated opening; the opening being straddled by two opposite interior, spaced apart long edges, the stencil base further comprising two exterior long edges, and a plurality of female stencil base cut-outs along at least one of the long edges; and (b) a plurality of stencil pieces of sufficient size for close insertion in the opening; the stencil pieces being formed of a common material and generally having a common length; the stencil pieces being interchangeably arrangeable in the opening between the interior long edges; a majority of the stencil pieces each comprising an individual character cut-out: the stencil piece character cut-outs being configured to receive a stenciling material; the stencil pieces further comprising at least one male stencil piece projection on at least one of its sides, the male stencil piece projection being insertable in at least one of the female stencil base cut-outs;

wherein the stencil base is generally rectangular in shape and further comprises downwardly extending legs in each of its four corners.

19. A lightweight, reusable stencil assembly for applying a design or message on a surface, the assembly comprising:

(a) a reusable stencil base framing an elongated opening, the opening being straddled by two opposite interior, spaced apart long edges; the stencil base further comprising at least one exterior long edge, and a plurality of female stencil base cut-outs along at least one of the long edges; and (b) a plurality of stencil pieces of sufficient size for close insertion in the opening; the stencil pieces being formed of a common material and generally having a common length; the stencil pieces being interchangeably arrangeable in the opening between the interior long edges; a majority of the stencil pieces each comprising an individual character cut-out; the stencil piece character cut-outs being configured to receive a stenciling material; the stencil pieces further comprising at least one male stencil piece projection on at least one of its sides, the male stencil piece projection being insertable in at least one of the female stencil base cut-outs;

wherein each of the two interior long edges and an upper one of the at least one exterior long edge comprises a series of the stencil base cut-outs.

20. A stencil assembly according to claim 19, wherein the stencil piece projections and the stencil base cut-outs have corners that are squared-off.

21. A stencil assembly according to claim 19, wherein the stencil base further comprises an end tab extending outwardly from each of the opposite ends of the stencil base, each end tab comprising a detachable coupling mechanism.

22. A stencil assembly according to claim 21, wherein the detachable coupling mechanism is a snap, each end tab comprising a corresponding snap member.

23. A stencil assembly according to claim 19, wherein the stencil piece projections are male dovetail projections corresponding to female dovetail base cut-outs on the stencil base.

24. A stencil assembly according to claim 23, wherein the stencil base comprises a hole in at least two of its four corners for receiving a pin.

25. A stencil assembly according to claim 23, wherein the stencil base further comprises pieces of a tacky material on its bottom face.

26. A stencil kit according to claim 23, wherein a minority of the stencil pieces are spacer pieces.

27. A stencil assembly according to claim 19, wherein at least one of the stencil pieces comprises a cut-out along a side of the at least one stencil piece, the stencil piece cut-out corresponding to a similarly shaped projection on a corresponding stencil piece or on the stencil base.

28. A stencil kit for stenciling a design or characters onto a surface, the kit comprising:

(a) between one and about four reusable, interconnectable stencil bases, each stencil base framing an elongated opening; the opening being straddled by two opposite interior long edges in parallel spaced relationship; each stencil base further comprising at least one exterior long edge in parallel spaced relationship to the interior long edges, and a plurality of female stencil base cut-outs along at least one of the long edges; and (b) a plurality of stencil pieces of sufficient size for close insertion in the opening of at least one of the stencil bases; the stencil pieces being formed of a common material and generally having a common length; the stencil pieces being interchangeably arrangeable in the opening between the interior long edges; a majority of the stencil pieces each comprising an individual character cut-out; the stencil piece character cut-outs being configured to receive a stenciling material; the stencil pieces further comprising at least one male stencil piece projection on at least one of its sides, the male stencil piece projection being insertable in at least one of the female stencil base cut-outs;

wherein an end tab extending outwardly from an end of a first stencil base comprises a male projection, and a corresponding end tab extending outwardly from an end of a second stencil base comprises a corresponding female cut-out.

29. A stencil kit according to claim 28, wherein the stencil bases are connectable end to end, or in parallel.

30. A stencil kit for stenciling a design or characters onto a surface, the kit comprising:

(a) at least two reusable, interconnectable stencil bases, each of the stencil bases framing an elongated opening; the opening being straddled by two opposite interior long edges in parallel spaced relationship; each stencil base further comprising at least one exterior long edge in parallel spaced relationship to the interior long edges, and a plurality of female stencil base cut-outs along at least one of the long edges; and (b) a plurality of stencil pieces of sufficient size for close insertion in the openings of the stencil bases, the stencil pieces being formed of a common material and generally having a common length; the stencil pieces being interchangeably arrangeable in the opening between the interior long edges; a majority of the stencil pieces each comprising an individual character cut-out; the stencil piece character cut-outs being configured to receive a stenciling material; the stencil pieces further comprising at least one male stencil piece projection on at least one of its sides, the male stencil piece projection being insertable in at least one of the female stencil base cut-outs; and further comprising lock and loop strip on a lower face of an upper end tab extending outwardly from a first one of the stencil bases, and a corresponding lock and loop strip on an upper face of a lower end tab extending outwardly from a second one of the stencil bases.

* * * * *